United States Patent [19]

Sessler et al.

[11] Patent Number: 4,742,548

[45] Date of Patent: May 3, 1988

[54] UNIDIRECTIONAL SECOND ORDER GRADIENT MICROPHONE

[75] Inventors: Martin Sessler, Darmstadt, Fed. Rep. of Germany; James E. West, Plainfield, N.J.

[73] Assignees: American Telephone and Telegraph Company, New York, N.Y.; Bell Telephone Laboratories, Incorporated, Murray Hill, N.J.

[21] Appl. No.: 684,575

[22] Filed: Dec. 20, 1984

[51] Int. Cl.[4] ..... H04R 1/40; H04R 1/02

[52] U.S. Cl. ..... 381/92; 181/179; 381/155; 381/169; 381/182

[58] Field of Search ..... 381/92, 87, 88, 86, 381/122, 169, 182, 188, 155, 205; 179/121 D, 146 R, 178; 367/129, 188; 181/153, 158, 171, 179, 198

[56] References Cited

U.S. PATENT DOCUMENTS

| | | | |
|---|---|---|---|
| 1,735,905 | 11/1929 | Martin et al. | 381/158 |
| 1,816,618 | 7/1931 | Sklar | 181/158 |
| 2,301,744 | 11/1942 | Olson | 381/87 |
| 2,396,222 | 3/1946 | Foldy | 367/129 |
| 3,403,223 | 9/1968 | Kleis et al. | 381/122 |
| 3,715,500 | 2/1973 | Sessler et al. | 179/121 D |
| 3,903,989 | 9/1975 | Bauer | 181/144 |
| 4,009,355 | 2/1977 | Paradowski | 381/155 |
| 4,122,910 | 10/1978 | Wehner | 181/198 |
| 4,127,749 | 11/1978 | Atoji et al. | 381/158 |
| 4,308,425 | 12/1981 | Momose et al. | 381/92 |
| 4,399,327 | 8/1983 | Yamamoto et al. | 179/121 D |

FOREIGN PATENT DOCUMENTS

| | | | |
|---|---|---|---|
| 211395 | 10/1960 | Austria | 381/92 |
| 212395 | 12/1960 | Austria | 381/92 |
| 1139770 | 1/1969 | United Kingdom | 179/121 D |

OTHER PUBLICATIONS

"Toroidal Microphones", by G. M. Sessler, J. E. West and M. R. Schroeder, Journal of the Acoustical Society of Am., vol. 46, No. 1 (Part 1), 1969, pp. 28–36.

*Primary Examiner*—Jin F. Ng
*Assistant Examiner*—Danita R. Byrd
*Attorney, Agent, or Firm*—Patrick E. Roberts; David R. Padnes

[57] ABSTRACT

A second order gradient microphone with unidirectional sensitivity pattern is obtained by housing each of two commerically available first order gradient microphones centrally within a baffle. The baffles have flat surfaces, are preferably square or circular and have parallel surfaces the two baffles being parallel to each other. The rotational axes of the microphones are arranged to coincide. The output signal from one of the microphones is subtracted from the delayed signal output of the other.

13 Claims, 7 Drawing Sheets

UNIDIRECTIONAL SECOND ORDER GRADIENT MICROPHONE

TECHNICAL FIELD

This invention relates to electroacoustic transducers and, more particularly, to a directional microphone with a unidirectional directivity pattern.

BACKGROUND OF THE INVENTION

Acoustic transducers with directional characteristics are useful in many applications. In particular, unidirectional microphones with their relatively large directivity factors are widely used. Most of these microphones are first order gradients which exhibit, depending on the construction details, directional characteristics described by $(a+\cos\theta)$, where a is a constant and $\theta$ is the angle relative to the rotational axis. Directivity factors ranging up to four can be obtained with such systems.

The directivity may be improved by utilizing second order gradient microphones. These microphones have a directional pattern given by $(a+\cos\theta)(b+\cos\theta)$ and yield maximum directivity fastors of nine. Wide utilization of such microphones was impeded by the more complicated design and the reduction of signal to noise when compared with the first order designs.

SUMMARY OF THE INVENTION

A second order gradient microphone with unidirectional sensitivity pattern is obtained by housing each of two commercially available first order gradient microphones centrally within a baffle. The baffles have flat surfaces, are preferably square or circular and have parallel surfaces, the two baffles being parallel to each other. The rotational axes of the microphones are arranged to coincide. The output signal from one of the microphones is subtracted from the delayed signal output from the other.

The unidirectional microphone exhibits a directional characteristics which is relatively frequency independent, has a three decibel beam width of the main lobe of ±40 degrees, and exhibits side lobes about fifteen decibels below the main lobe. After equalization, the frequency response of the microphone in its direction of maximum sensitivity is within ±3 dB between 0.3 kHz and 4 kHz. The equivalent noise level of the microphone amounts to 28 dB SPL.

The following advantages over the prior art are realized with the present invention. The preferred embodiment has a smaller size for the same sensitivity. The effective spacing between the two surfaces of each microphone is increased, thus directly increasing the sensitivity of the system without introducing undesirable side effects. The preferred embodiment uses simple commercially available first order gradient electret microphones. Any type of first order, small transducer may be used. A signal to noise ratio of about thirty decibels for normal speech level is obtained. There is an extended band width over prior art systems. The embodiment is simple to make.

One immediate application for this invention is in mobile radio which requires high directional sensitivity and small size.

DETAILED DESCRIPTION

Figure 1:
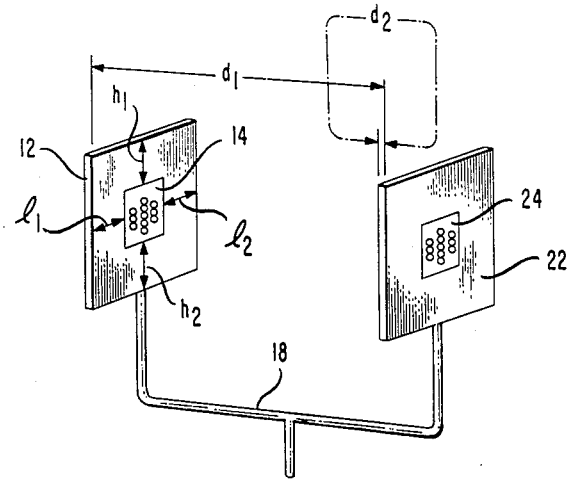
FIG. 1 shows the preferred embodiment of the present invention.

The preferred embodiment of the present invention is shown in FIG. 1. The unidirectional microphone arrangement comprises two commercial first order gradient bidirectional microphones 14 and 24 such as Knowles model BW-1789 of size $8\times4\times2$ mm$^3$ or the ATT-Technologies EL-3 electret microphones when the rear cavity is opened to the sound field to form a first order gradient. These microphones are placed in openings cut into two square or circular LUCITE, or other plastic, baffles 12 and 22 of size $3\times3$ cm 2 or 3 cm diameter, respectively. The gaps between microphones 14 and 24 and baffles 12 and 24 are sealed with epoxy. As shown in FIG. 1, baffled microphones 14 and 24 are arranged at a distance of 5 cm apart and are oriented such that the axes of microphones 14 and 24 coincide. Microphones 14 and 24 are located in baffles 12 and 22 so that the distance $h_1$ from the top of the microphones to the top of the baffles equal the distance $h_2$ from the bottom of the microphones to the bottom of the baffles. Likewise, the distance $l_1$ from one side of the microphones to the nearest edge of the baffles equals the distance from the opposite edge of the microphones to the nearest edges of the baffles. The baffles 12 and 22 are suitably supported by a device 18.

Figure 2:
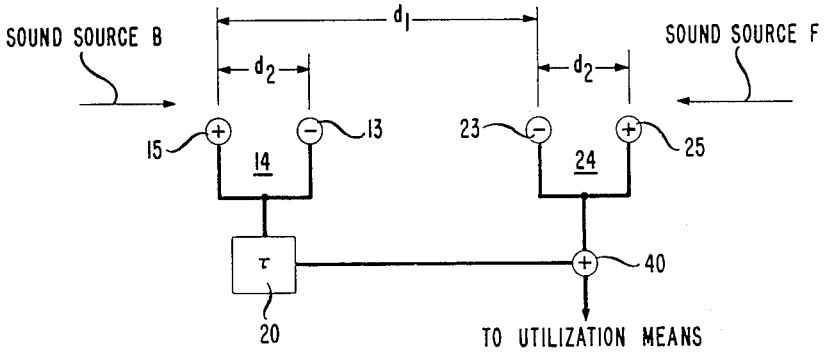
FIGS. 2, 3 and 4 are useful in disclosing the principles on which the present invention is based.

The principle of the present invention will become clear by referring to FIG. 2. Microphone 14 is shown comprising two sensors: positive sensor 15 and negative sensor 13 separated by a distance $d_2$. Likewise, microphone 24 is shown comprising two sensors: positive sensor 25 and negative sensor 23 separated by a distance $d_2$. Each sensor corresponds to a face of a microphone. The distance between the two microphones is $d_1$. The microphones are arranged, in one embodiment, so that like polarities face each other.

Figure 3:
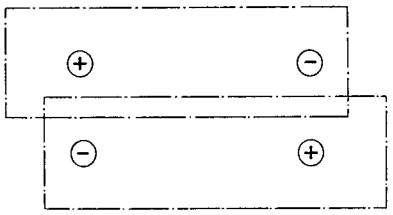

Assume a plane sound wave traveling from source B impinges on the device of FIG. 2. The sound will first be picked up by microphone 14 and then the output from microphone 14 is passed through delay circuit 20. After impinging on microphone 14, the sound from source B must travel a distance $d_1$ before impinging microphone 24. If the delay $\tau$ is made to equal the distance $d_1$, the sound signals from microphones 14 and 24 will cancel each other and there will be no output from the device. The overlapping of the two sound signals is shown conceptually in FIG. 3.

Assume now that a sound radiates from source F. The sound will first impinge microphone 24. The sound will next travel a distance $d_1$ to microphone 14 and be returned through delay circuit 20, and, as readily seen, be added with the sound from microphone 24 to derive an output.

Figure 4:
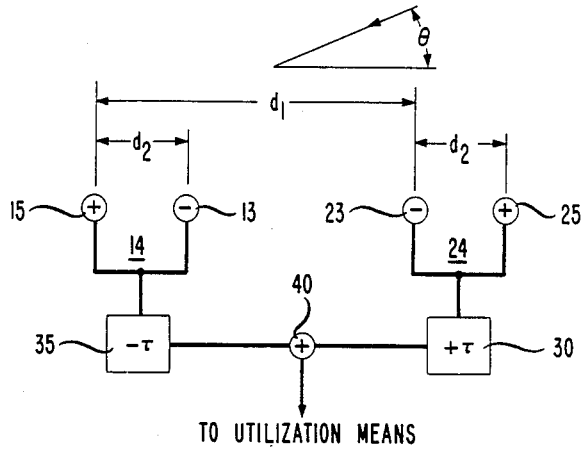
Figure 5:
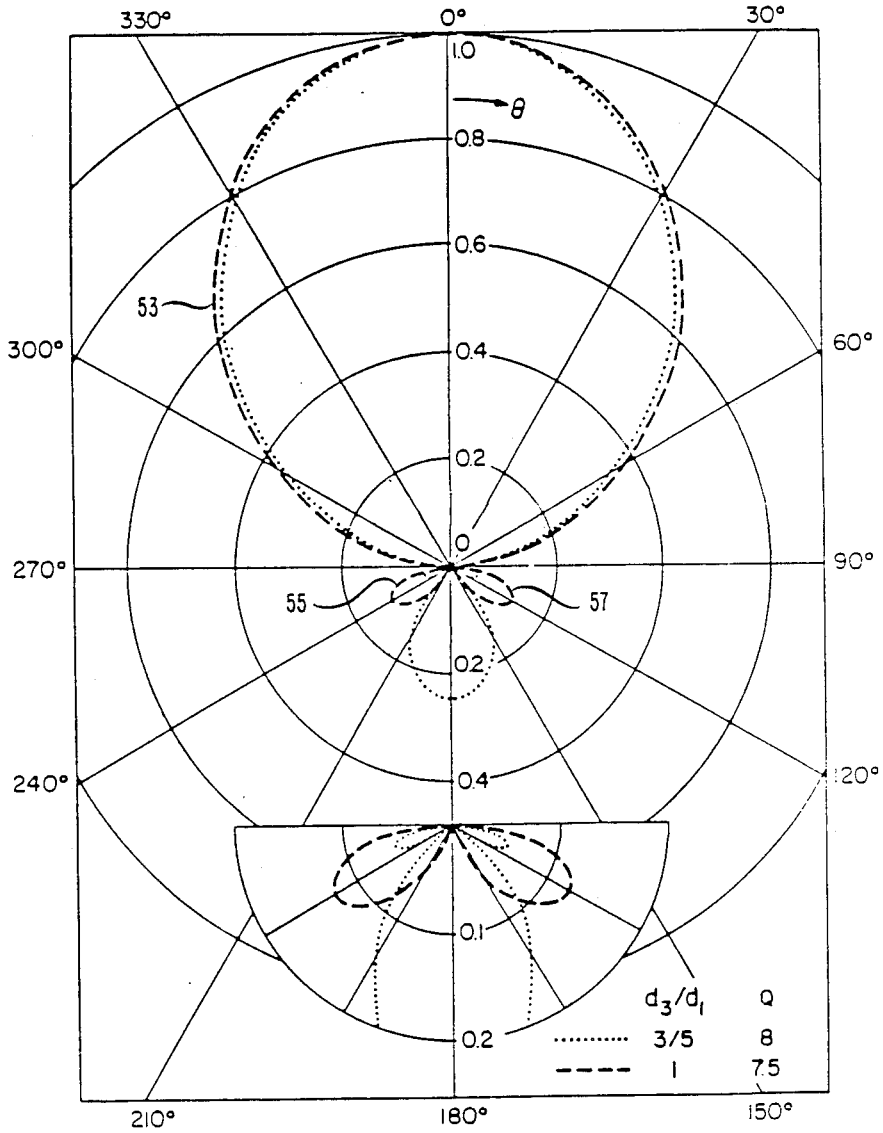
FIGS. 5, 8, 9 and 10 show response patterns.

Referring to FIG. 4, there is shown FIG. 2 which has been redrawn to show two separate delay circuits $+\tau$, 30, and $-\tau$, 35. The signal outputs from these delay circuits are then added by circuit 40. If the output signal from one of the microphones is delayed by $2\tau$ relative to the other, the sensitivity of the entire system is given by $$M=-M_0k^2\,d_1\,d_2\,[(d_3/d_1)+\cos\theta]\cos\theta \qquad (1)$$

where, $M_0$ is the sensitivity of each of the sensors 13, 15, 23 and 25, the wave number $k=\omega/c$, $\omega$ is the angular frequency, c is the velocity of sound, $d_3$ equals $2c\tau$ and $\theta$ is the direction of sound incidence relative to the line connecting the sensors. Depending on the ratio of $d_3/d_1$, various directional patterns with different directivity indexes are obtained. Two examples are shown in FIG. 5. The design with $d_3/d_1=1$ yields a directivity factor of 7.5 while that with $d_3/d_1=3/5$ yields the highest achievable factor of 8. Directivity factors up to 9 can be achieved by inserting additional delays in the outputs of the individual sensors in FIG. 4.

Baffles, such as 12 and 22 of FIG. 1, are used in the present invention to increase the acoustic path difference between the two sound inlets of each gradient, that is, between the two surfaces (inner and outer) of microphones 14 and 24 by changing the distances $h_1$, $h_2$, $l_1$, and $l_2$. Thus, the spacing $d_2$ in FIG. 4 is determined by the size of baffles 12 and 22 of FIG. 1.

Figure 6:
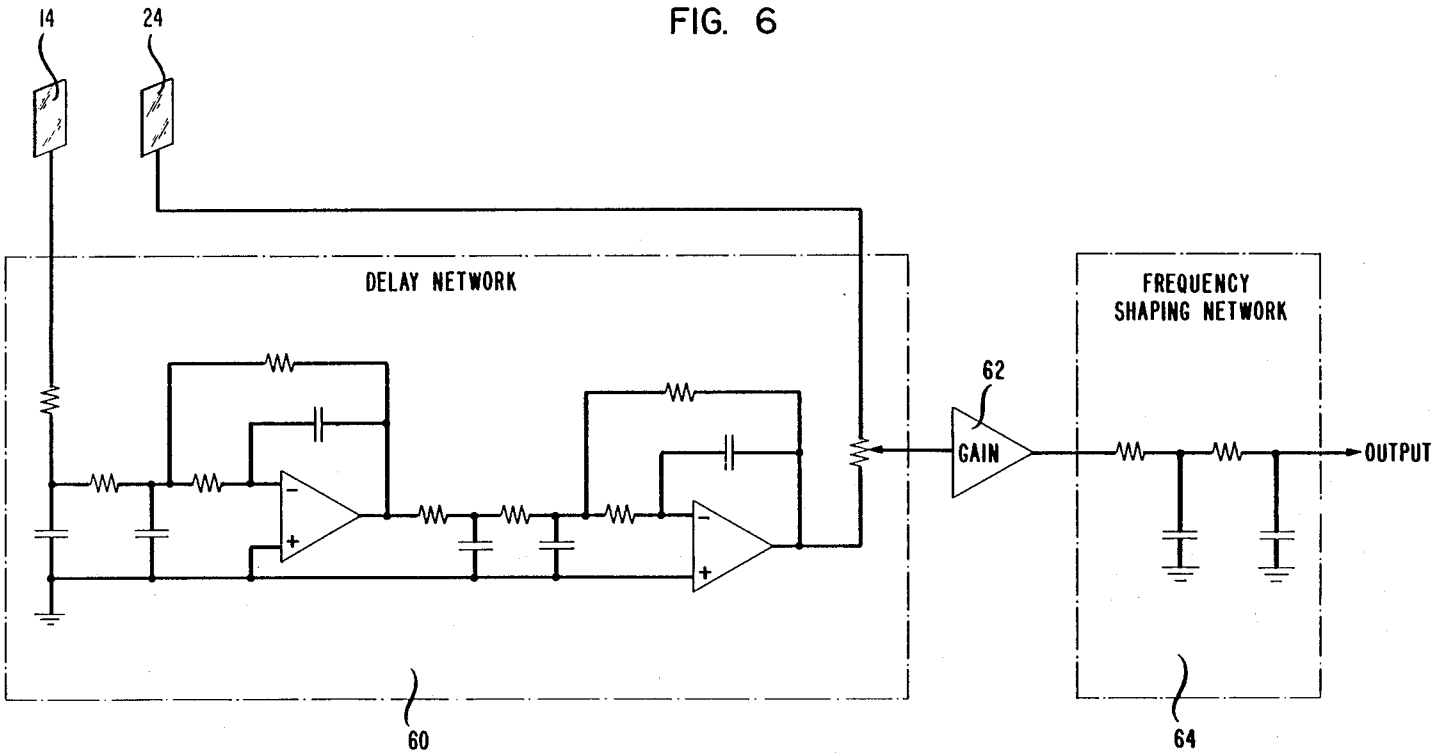
FIGS. 6 and 7 show the signal path.

The output from one of gradient microphones 14 or 24 can be delayed, for example, by a third order Butterworth filter with a delay time of 150 $\mu$s, corresponding to the separation $d_1$ between microphones 14 and 24. By this means, a delay ratio of $d_3/d_1$ is obtained. Butterworth filter 60, amplifier 62 and low pass filter 64 for correcting the $\omega^2$ frequency dependence are shown in FIG. 6. The corresponding theoretical polar pattern for this device is shown in FIG. 5. The pattern comprises a main lobe 53 and two small side lobes 55 and 57 which are, if the three dimensional directivity pattern is considered, actually a single deformed toroidal side lobe.

Measurements on the unidirectional microphone were carried out in an anechoic chamber. The microphone was mounted on a B & K model 3922 turntable and exposed to plane and spherical sound fields. The results were plotted with a B & K model 2307 level recorder.

Figure 7:
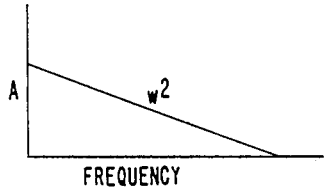

The output of the microphone was first amplified forty decibels and then passed through a two stage RC filter to correct the $\mu^2$ frequency dependence of the second order system as shown in FIGS. 6 and 7. A band pass filter, for the range 0.25 through 3.5 kHz, was used to eliminate the out of band noise.

Figure 8:
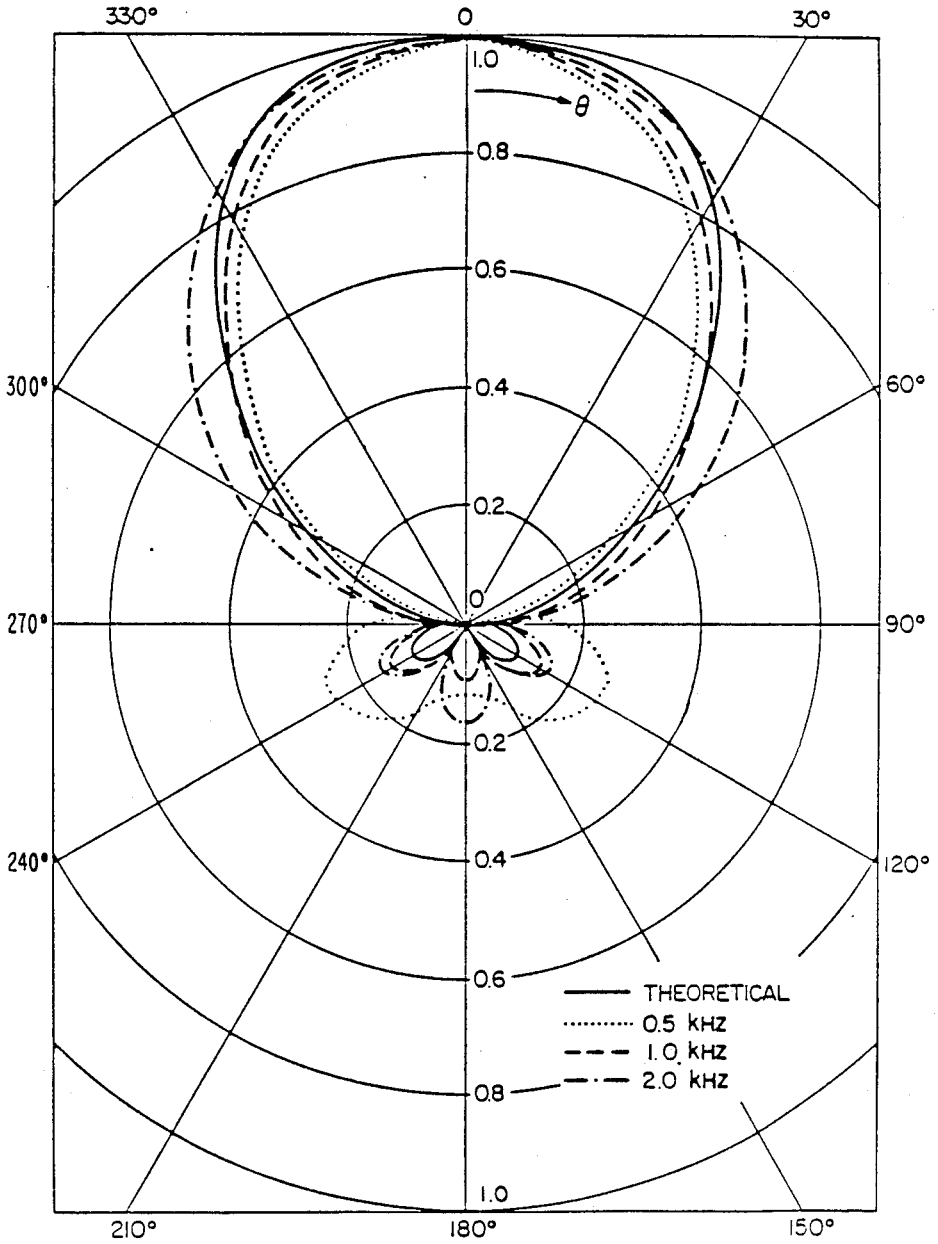

The directional characteristics of the unidirectional microphone for a plain sound field, source located about two meters from the microphone, are shown in FIG. 8. The figure also shows expected theoretical polar response $[\frac{1}{2}\cos\theta(1+\cos\theta)]$for the second order unidirectional system chosen here. At 1 kHz and 2 kHz the experimental results are in reasonable agreement with theory. At 500 Hz the side lobes are only 12 dB down, but 8 dB larger than predicted. At all frequencies, the microphone has a nonvanishing sensitivity in the backward direction. Inspection of FIG. 5 suggests that this is due to a deviation of $d_3/d_1$ from the value of 1 or differences in the frequency and phase response of the first order gradient sensors.

Figure 9:
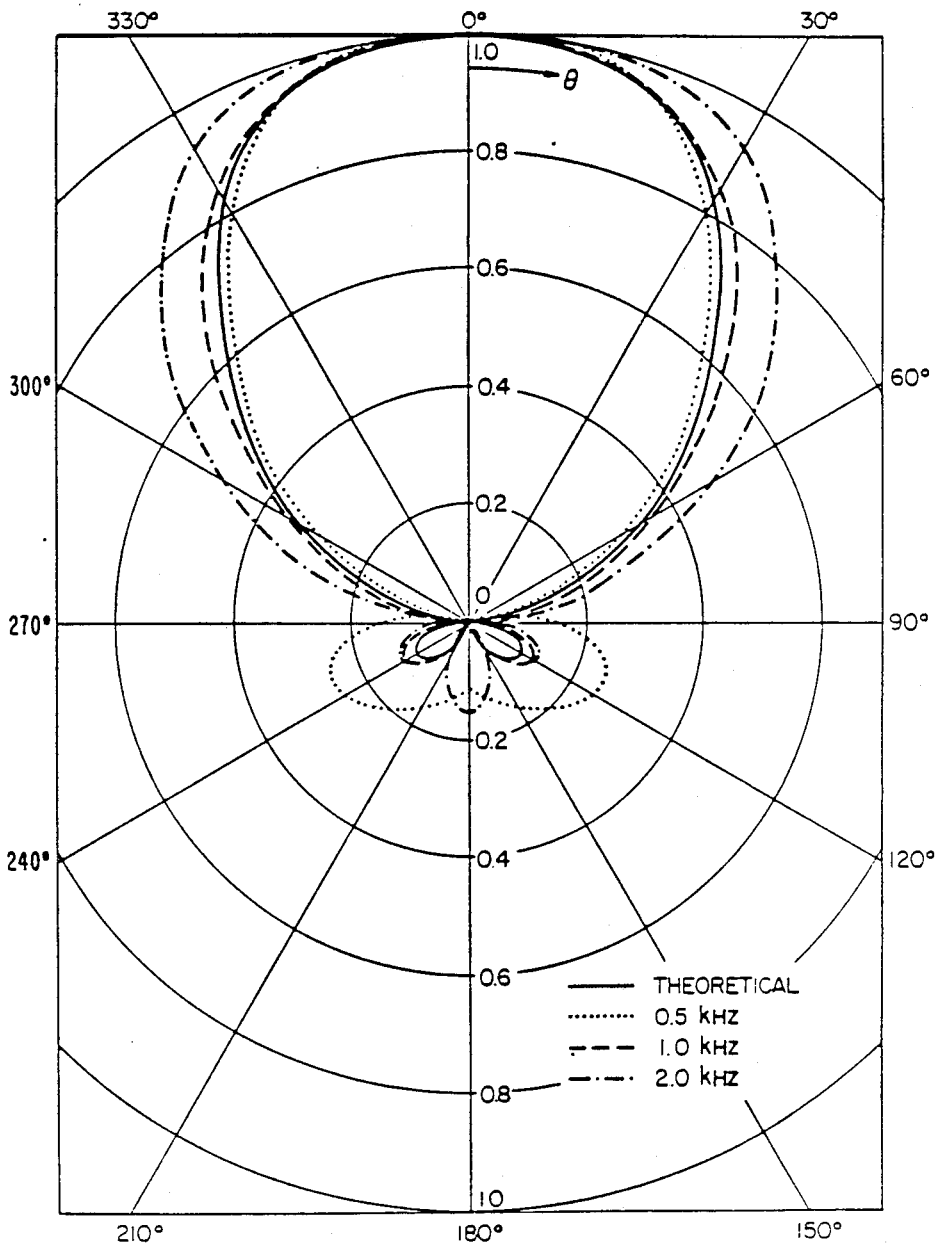

The performance of such a directional microphone exposed to the sound fields of a sound source at a finite distance is of considerable interest for their use in small noisy spaces. FIG. 9 shows the polar response for a sound source located at a distance of 0.5 meter. Surprisingly, the directional characteristics are about the same as for the plane wave case. This could be due to poor anechoic conditions.

Figure 10:
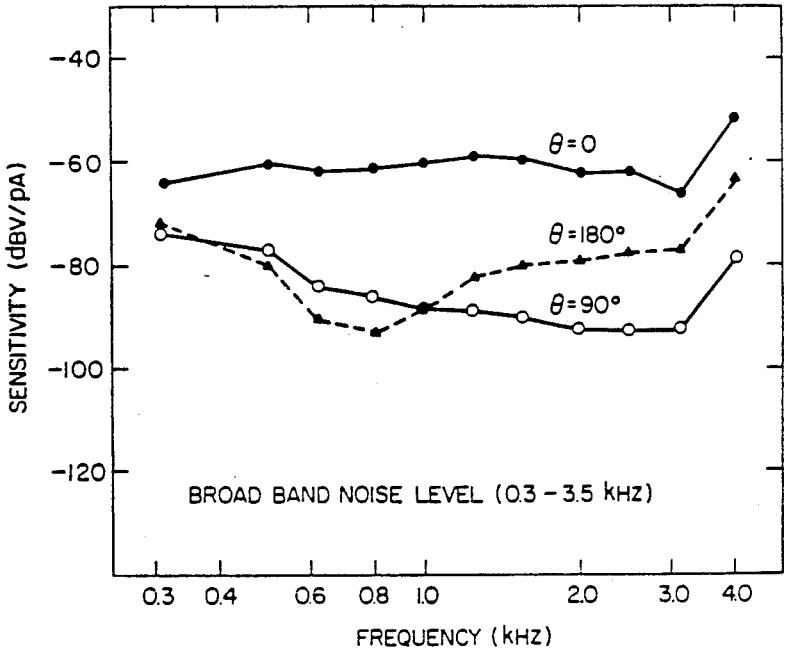

The corrected frequency responses of the microphone for $\phi=0$, 90 and 180 degrees are shown in FIG. 10 for $\frac{1}{3}$ octave band noise excitation. The sensitivity of the microphone at 1 kHz is $-60$ dBV/Pa in the direction of maximum sensitivity at $\phi=0$ degrees. The microphone has a frequency response within $\pm3$ dB from 0.3 kHz to 4 kHz. In the direction of minimum sensitivity, $\phi=90$ and 180 degrees, the response is $-15$ dB down between 0.45 kHz and 2 kHz. The equivalent noise level of the microphone measured for the frequency range 0.25 kHz to 3.5 kHz, is 28 dB.

Figure 11:
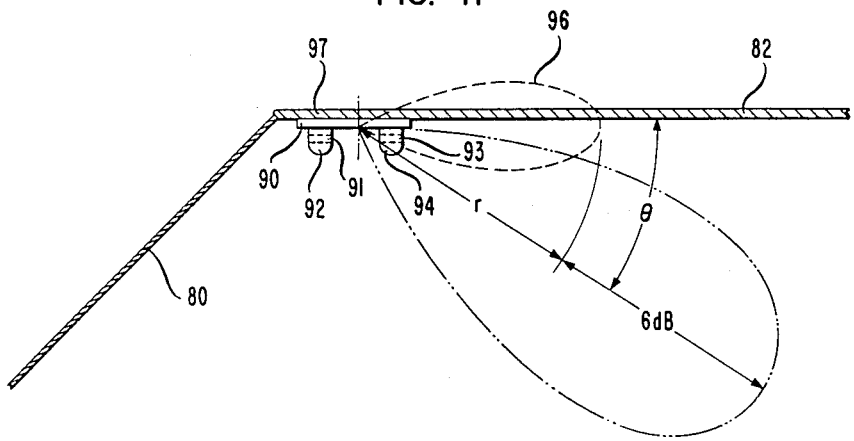
FIG. 11 shows an application of the present invention.

This invention finds use in mobile radio. Referring to FIG. 11, there is shown a directional microphone embodying the present invention located under roof 82 of an automobile near windshield 80 and near the driver who is not shown. The microphone arrangement comprises a base 90 having two parallel baffles 92 and 94 housing respectively microphones 91 and 93 in a manner described hereinabove. The normal response pattern is shown by lobe 96. The dimensions of roof 82 of the car is large in comparison with the wave length of sound in the speech range. This causes lobe 96 to sag and double in intensity, caused by the well known pressure doubling effect. As stated hereinabove, by adjusting the dimensions of the baffle the directivity and the size of the lobe is controlled.

Figure 12:
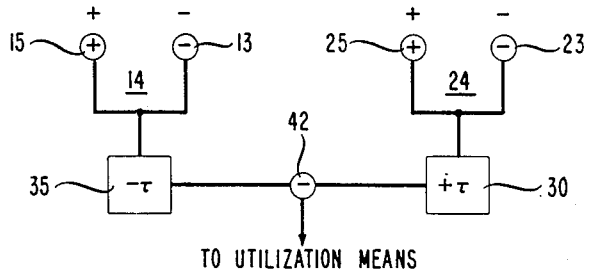
FIG. 12 shows an alternate arrangement to FIG. 4.

There is shown in FIG. 12 an alternate arrangement to that shown in FIG. 4 for the microphones 14 and 24 of FIG. 1. Sensor 13 of microphone 14 and sensor 25 of microphone 24 are made to face each other. The output signals from microphones 14 and 24 are subtracted in this case. Such an arrangement is needed when the sensors are not truly first order gradients.

What is claimed is:

1. A microphone arrangement for use with incident wave energy whose frequency varies from a first to a second frequency, said second frequency being substantially greater than said first frequency and the first and second frequencies respectively corresponding to a first and a second wavelength, said arrangement comprising a plurality of first order gradient microphones, each microphone having first and second sensing surfaces separated by a first acoustical path, and each microphone providing an output signal;

a plurality of baffles, each baffle receiving at least one associated microphone, each baffle blocking said first acoustical path of each associated microphone and creating a second acoustical path, said second acoustical path being greater than said first acoustical path and substantially less than said second wavelength; and means for combining the output signals of said microphones to provide a second order directional response pattern for said microphone arrangement.

2. The arrangement of claim 1 wherein said combining means adds the output signals from said microphones.

3. The arrangement of claim 1 wherein said combining means subtracts the output signals from said microphones.

4. The arrangement of claim 1 wherein said combining means includes at least one delay element which delays an associated one of said output signals.

5. The arrangement of claim 1 wherein said first and second sensing surfaces are parallel to one another.

6. The arrangement of claim 1 wherein said sensing surfaces of each microphone have a different one of two polarities.

7. The arrangement of claim 6 wherein said microphones are arranged with sensing sufaces of the same polarity facing one another.

8. The arrangement of claim 6 wherein said microphones are arranged with sensing surfaces of different polarities facing one another.

9. The arrangement of claim 1 wherein a pair of microphones is substantially parallel and separated by a distance less than said second wavelength.

10. The arrangement of claim 1 wherein each microphone is centrally disposed within an associated baffle.

11. The arrangement of claim 1 further including at least one additional baffle connected to said microphones, each additional baffle being greater in size than said second wavelength.

12. A method of producing a directional sensitivity pattern for a microphone arrangement for use with incident wave energy whose frequency varies from a first to a second frequency, said second frequency being substantially greater than said first frequency and the first and second frequencies respectively corresponding to first and second wavelengths, said method comprising the steps of perforating a recess through each baffle in a pair, placing a bidirectional first order microphone having first and second sensing surfaces separated by a first acoustical path into each recess, the placement of each microphone replacing said first acoustical path with a second acoustical path, said second acoustical path being substantially less than said second wavelength, each microphone providing an output signal, and combining the output signals of each microphone.

13. The method of claim 12 further comprising the step of introducing a delay into the output of at least one of said microphones prior to combining the microphone output signals.

* * * * *